US011872614B2

(12) United States Patent
Wang et al.

(10) Patent No.: US 11,872,614 B2
(45) Date of Patent: Jan. 16, 2024

(54) EMULSION FLOW OPTIMIZATION METHOD FOR SUPPRESSING VIBRATION OF COLD CONTINUOUS ROLLING MILL

(71) Applicant: BAOSHAN IRON & STEEL CO., LTD., Shanghai (CN)

(72) Inventors: Kangjian Wang, Shanghai (CN); Peilei Qu, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 455 days.

(21) Appl. No.: 17/258,230

(22) PCT Filed: Jul. 24, 2019

(86) PCT No.: PCT/CN2019/097396
§ 371 (c)(1),
(2) Date: Jan. 6, 2021

(87) PCT Pub. No.: WO2020/020191
PCT Pub. Date: Jan. 30, 2020

(65) Prior Publication Data

US 2021/0283669 A1 Sep. 16, 2021

(30) Foreign Application Priority Data

Jul. 24, 2018 (CN) ..... 201810818600.7

(51) Int. Cl.
*B21B 37/00* (2006.01)
*B21B 45/02* (2006.01)

(52) U.S. Cl.
CPC ..... *B21B 37/007* (2013.01); *B21B 45/0239* (2013.01); *B21B 2037/002* (2013.01)

(58) Field of Classification Search
CPC . B21B 37/007; B21B 37/66; B21B 2037/002; B21B 45/0251; B21B 45/0266
(Continued)

(56) References Cited

FOREIGN PATENT DOCUMENTS

CN 103544340 A 1/2014
CN 103611732 A 3/2014
(Continued)

OTHER PUBLICATIONS

International Search Report & Written Opinion dated Sep. 25, 2019 in PCT Application No. PCT/CN2019/097396.
(Continued)

*Primary Examiner* — Jimmy T Nguyen
*Assistant Examiner* — Smith Oberto Bapthelus
(74) *Attorney, Agent, or Firm* — Lei Fang, Esq.; Smith Tempel Blaha LLC

(57) ABSTRACT

An emulsion flow optimization method suitable for a cold continuous rolling mill that aims to achieve vibration suppression. The method aims to suppress vibrations by an oil film thickness model and a friction coefficient model. An optimum set value of the emulsion flow rate for each rolling stand that aims to achieve vibration suppression is optimized on the basis of an over-lubrication film thickness critical value and an under-lubrication film thickness critical value that are proposed. The method greatly reduces the incidence of rolling mill vibration defects, improves production efficiency and product quality, treats rolling mill vibration defects, and improves the surface quality and rolling process stability of a finished strip of a cold continuous rolling mill.

5 Claims, 4 Drawing Sheets

(58) Field of Classification Search
USPC ..... 72/11.1
See application file for complete search history.

(56) References Cited

FOREIGN PATENT DOCUMENTS

| | | | | |
|---|---|---|---|---|
| CN | 104289527 | | * | 1/2015 |
| CN | 104289527 | A | | 1/2015 |
| CN | 104858241 | A | | 8/2015 |
| CN | 105312321 | A | | 2/2016 |
| CN | 106311754 | A | | 1/2017 |
| CN | 107520253 | A | | 12/2017 |
| CN | 108057719 | A | | 5/2018 |
| JP | 2002346614 | A | | 12/2002 |

OTHER PUBLICATIONS

EP Search Report for EP App No. 19842046.5, dated Aug. 16, 2021.
JP First Office Action dated Jan. 24, 2021.

* cited by examiner

EMULSION FLOW OPTIMIZATION METHOD FOR SUPPRESSING VIBRATION OF COLD CONTINUOUS ROLLING MILL

CROSS-REFERENCE TO RELATED APPLICATIONS

This application is a 371 U.S. National Phase of PCT International Application No. PCT/CN2019/097396 filed on Jul. 24, 2019, which claims benefit and priority to Chinese patent application no. 201810818600.7 filed on Jul. 24, 2018, contents of both are incorporated by reference herein in their entireties.

TECHNICAL FIELD

The invention relates to the technical field of cold continuous rolling, in particular to an emulsion flow optimization method for suppressing vibration of a cold continuous rolling mill.

BACKGROUND

Rolling mill vibration defect is always one of the difficult problems that perplex the high-speed and stable production of an on-site cold continuous rolling mill and ensure the surface quality of finished strip. In the past, on-site treatment of rolling mill vibration defects generally depends on the control over the speed of the rolling mill, by which the vibration defects can be weakened, but the improvement of production efficiency is restricted and the economic benefits of enterprises are seriously affected. However, for the cold continuous rolling mill, its device and process features determine the potential of vibration suppression. Therefore, setting reasonable process parameters is the core means for vibration suppression. Through theoretical research and on-the-spot tracking, it is found that the rolling mill vibration is directly related to the lubrication state between the roll gaps. If the roll gaps are in an over-lubrication state, it is indicated that the friction coefficient is too small, thus it is likely to cause slip in the rolling process to cause the self-excited vibration of the rolling mill; if the roll gap is in an under-lubrication state, it is indicated that the average oil film thickness between the roll gaps is less than the required minimum value, thus it is likely to cause sharp increase of the friction coefficient due to rupture of oil films in the roll gaps during the rolling process, which leads to the change of rolling pressure and periodic fluctuation of system stiffness, and thus also causes self-excited vibration of the rolling mill. It can be seen that the key to suppress the vibration of the rolling mill is to control the lubrication state between the roll gaps. On the premise that the rolling schedule, the rolling process and process parameters such as the emulsion concentration and the initial temperature are determined, the setting of emulsion flow rate directly determines the roll gap lubrication state of each rolling stand of the cold continuous rolling mill, and is the main process control means of the cold continuous rolling mill.

The patent No. 201410522168.9 discloses a cold continuous rolling mill vibration suppression method, which comprises the following steps: 1) arranging a cold rolling mill vibration monitoring device on the fifth or fourth rolling stand of the cold continuous rolling mill, and determining whether the rolling mill is about to vibrate by the energy of a vibration signal; 2) arranging a liquid injection device which can independently adjust the flow rate in front of an inlet emulsion injection beam of the fifth or fourth rolling stand of the cold rolling mill; and 3) calculating the forward slip value to determine whether to turn on/off the liquid injection device. The patent No. 201410522168.9 discloses a comprehensive emulsion flow optimization method for ultra-thin strip rolling of a cold continuous rolling mill. The existing device parameters and process parameter data of a cold continuous rolling mill control system are used to define the process parameters of comprehensive emulsion flow optimization considering the slip, vibration and hot slide injury as well as shape and pressure control, and determine the optimal flow rate distribution value of each rolling stand under the current tension schedule and rolling reduction schedule. The comprehensive optimization setting of emulsion flow rate for ultra-thin strip rolling is realized by computer program control. The above patents mainly focus on monitoring equipment, forward slip calculation model, emulsion flow rate control and other aspects to realize rolling mill vibration control; vibration is only a constraint condition of emulsion flow rate control, and is not the main treatment object.

SUMMARY

(I) Technical Problems Solved

The purpose of the invention is to provide an emulsion flow optimization method for suppressing vibration of a cold continuous rolling mill. The method aims to suppress vibrations, and by means of an oil film thickness model and a friction coefficient model, comprehensive optimization setting for the emulsion flow rate for each rolling stand is realized on the basis of an over-lubrication film thickness critical value and an under-lubrication film thickness critical value that are proposed so as to achieve the goals of treating rolling mill vibration defects, and improving the surface quality of a finished strip.

(II) Technical Solution

An emulsion flow optimization method for suppressing vibration of a cold continuous rolling mill includes the following steps:

S1, collecting device feature parameters of the cold continuous rolling mill, wherein the device feature parameters include: the radius $R_i$ of a working roll of each rolling stand, the surface linear velocity $v_{ri}$ of a roll of each rolling stand, the original roughness $Ra_{ir0}$ of a working roll of each rolling stand, the roughness attenuation coefficient $B_L$ of a working roll, the distance l between rolling stands, and the rolling kilometer $L_i$ after roll change of a working roll of each rolling stand, wherein i is 1, 2, . . . , n, and represents for the ordinal number of rolling stands of the cold continuous rolling mill, and n is the total number of rolling stands;

S2, collecting key rolling process parameters of a strip, wherein the key rolling process parameters include: the inlet thickness $h_{0i}$ of each rolling stand, the outlet thickness $h_{1i}$ of each rolling stand, strip width B, the inlet speed $v_{0i}$ of each rolling stand, the outlet speed $v_{1i}$ of each rolling stand, the inlet temperature $T_1^r$, strip deformation resistance $K_i$ of each rolling stand, rolling pressure $P_i$ of each rolling stand, back tension $T_{0i}$ of each rolling stand, front tension $T_{1i}$ of each rolling stand, emulsion concentration influence coefficient $k_c$, pressure-viscosity coefficient θ of a lubricant, strip density ρ, specific heat capacity S of a strip, emulsion concentration C, emulsion temperature $T_c$ and thermal-work equivalent J;

S3, defining process parameters involved in the process of emulsion flow optimization, wherein the process parameters include that an over-lubrication film thickness critical value of each rolling stand is $\xi_i^+$ and the friction coefficient at this time is $u_i^+$, an under-lubrication film thickness critical value is $\xi_i^+$ and the friction coefficient at this time is $u_i^-$, the rolling reduction amount is $\Delta h_i = h_{0i} - h_{1i}$, the rolling reduction rate is $$\varepsilon_i = \frac{\Delta h_i}{h_{0i}},$$

and the inlet temperature of each rolling stand is $T_i^r$, the distance l between the rolling stands is evenly divided into m sections, and the temperature in the sections is represented by $T_{i,j}$ (wherein, $1 \le j \le m$), and $T_i^r = T_{i-1,m}$, the over-lubrication judgment coefficient is $A^+$, and the under-lubrication judgment coefficient is $A^-$;

S4, setting the initial set value of an emulsion flow rate comprehensive optimization objective function of the cold continuous rolling mill that aims to achieve vibration suppression as $F_0 = 1.0 \times 10^{10}$;

wherein the executing order of steps S1 to S4 is not limited.

S5, calculating the bite angle $\alpha_i$ of each rolling stand according to the rolling theory, wherein the calculation formula is as follows:

$$\alpha_i = \sqrt{\frac{\Delta h_i}{R_i'}}, R_i'$$

is the flattening radius of the working roll of the $i^{th}$ rolling stand, and is the calculation process value of rolling pressure;

S6, calculating the vibration determination index reference value $\xi_{0i}$ of each rolling stand;

S7, setting the emulsion flow rate $w_i$ of each rolling stand;

S8, calculating the strip outlet temperature $T_i$ of each rolling stand;

S9, calculating an emulsion flow rate comprehensive optimization objective function F(X):

$$\begin{cases} F(X) = \frac{\lambda}{n}\sum_{i=1}^{n}\sqrt{(\xi_i - \xi_{0i})^2} + (1-\lambda)\max|\xi_i - \xi_{0i}| \\ \xi_i^- < \xi_i < \xi_i^+ \end{cases};$$

S10, determination whether the in-equation $F(X) < F_0$ is established, if yes, enabling $w_i^y = w_i$, $F_0 = F(X)$, and then turning to step S11, since $F_0 = 1.0 \times 10^{10}$ under the initial circumstance, the value is very large, in the first calculation process, F(X) must be smaller than $F_0$, and in the subsequent x calculation processes, the corresponding F(X) is obtained with the change of $w_i$, and the $x^{th}$ $F_0$ is the $x-1^{th}$ F(X), if the $x^{th}$ F(X) is smaller than the $x-1^{th}$ F(X), it is determined that $F(X) < F_0$ is established and turn to step S11; otherwise, turning directly to step S11;

S11, determining whether the emulsion flow rate $w_i$ exceeds a feasible region range, if yes, turning to step S12; otherwise, turning to step S7, wherein the feasible region of $w_i$ ranges from 0 to the maximum emulsion flow rate value allowed by the rolling mill.

S12, outputting an optimal emulsion flow rate set value $w_i^y$, wherein $w_i^y$ is the value of $w_i$ when the calculated value of F(X) in the feasible region is minimum.

According to an embodiment of the present invention, the step S6 includes the following steps:

S6.1, calculating the neutral angle $\gamma_i$ of each rolling stand:

$$\gamma_i = \frac{1}{2}\sqrt{\frac{\Delta h_i}{R_i'}}\left[1 + \frac{1}{2u_i}\left(\sqrt{\frac{\Delta h_i}{R_i'}} + \frac{T_{i0} - T_{i1}}{P_i}\right)\right];$$

S6.2, calculating to obtain $$u_i^+ = \frac{1}{2(2A^+ - 1)}\left(\sqrt{\frac{\Delta h_i}{R_i'}} + \frac{T_{i0} - T_{i1}}{P_i}\right)$$

from steps S5 and S6.1 assuming that when $$\frac{\gamma_i}{\alpha_i} = A^+,$$

the roll gap is just in an over-lubrication state;

S6.3, calculating an over-lubrication film thickness critical value $\xi_i^+$ of each rolling stand according to the relationship formula between the friction coefficient and the oil film thickness, namely $u_i = a_i + b_i \cdot e^{B \cdot \xi_i}$ (in the formula, $a_i$ is the liquid friction influence coefficient, $b_i$ is the dry friction influence coefficient, and $B_i$ is the friction coefficient attenuation index), wherein $$\xi_i^+ = \frac{1}{B_i}\ln\frac{u_i^+ - a_i}{b_i};$$

S6.4, calculating to obtain $$u_i^- = \frac{1}{2(2A^- - 1)}\left(\sqrt{\frac{\Delta h_i}{R_i'}} + \frac{T_{i0} - T_{i1}}{P_i}\right)$$

from steps S5 and S6.1 assuming that when $$\frac{\gamma_i}{\alpha_i} = A^-,$$

the roll gap is just in an under-lubrication state;

S6.5, calculating an under-lubrication film thickness critical value $\xi_i^-$ of each rolling stand according to the relationship formula between the friction coefficient and the oil film thickness, namely $u_i = a_i + b_i \cdot e^{B \cdot \xi_i}$, wherein $$\xi_i^- = \frac{1}{B_i}\ln\frac{u_i^- - a_i}{b_i};$$

and

S6.6, calculating the vibration determination index reference value $\xi_{0i}$ of each rolling stand, wherein $$\xi_{0i} = \frac{\xi_i^+ + \xi_i^-}{2}.$$

According to an embodiment of the present invention, the step S8 includes the following steps:

S8.1, calculating the outlet temperature $T_1$ of the first rolling stand, wherein $$T_1 = T_1^r + \frac{1-(\varepsilon_1/4)}{1-(\varepsilon_1/2)} \cdot \frac{K_1 \ln\left(\frac{1}{1-\varepsilon_1}\right)}{\rho SJ};$$

S8.2, enabling i=1;

S8.3, calculating the temperature $T_{i,1}$ of the first section of strip behind the outlet of the $i^{th}$ rolling stand, i.e. $T_{i,1}=T_i$;

S8.4, enabling j=2;

S8.5, showing the relationship between the temperature of the $j^{th}$ section and the temperature of the $j-1^{th}$ section by the following equation:

$$T_{i,j} = -\frac{2k_0 w_i^{0.264} \exp(9.45 - 0.1918C) \times 1.163l}{v_{1i} h_{1i} \rho Sm} T_{i,j-1}^{-0.213}(T_{i,j-1} - T_c) + T_{i,j-1},$$

wherein $k_0$ is the influence coefficient of the nozzle shape and spraying angle, and $0.8<k_0<1.2$;

S8.6, determining whether the in-equation j<m is established, if yes, enabling j=j+1, and then turning to step S8.5; otherwise, turning to step S8.7;

S8.7, obtaining the temperature $T_{i,m}$ of the $m^{th}$ section by iterative calculation;

S8.8, calculating the inlet temperature $T_{i+1}^r$ of the $i+1^{th}$ rolling stand: $T_{1+1}^r=T_{i,m}$;

S8.9, calculating the outlet temperature $T_{i+1}$ of the $i+1^{the}$ rolling stand, wherein $$T_{i+1} = T_{i+1}^r + \frac{1-(\varepsilon_{i+1}/4)}{1-(\varepsilon_{i+1}/2)} \cdot \frac{K_{i+1} \ln\left(\frac{1}{1-\varepsilon_{i+1}}\right)}{\rho SJ};$$

S8.10, determining whether the in-equation i<n is established, if yes, enabling i=i+1, and then turning to step S8.3; otherwise, turning to step S8.11; and S8.11, obtaining the outlet temperature $T_i$ of each rolling stand.

According to an embodiment of the present invention, the step S9 includes the following steps:

S9.1, calculating the dynamic viscosity $\eta_{0i}$ of an emulsion between roll gaps of each rolling stand, wherein $\eta_{0i}=b\cdot\exp(-a\cdot T_i)$, in the formula, a,b are the dynamic viscosity parameters of lubricating oil under atmospheric pressure;

S9.2, calculating the oil film thickness $\xi_i$ between the roll gaps of each rolling stand, wherein the calculation formula is as follows:

$$\xi_i = \frac{h_{0i} + h_{1i}}{2h_{0i}} \cdot k_c \cdot \frac{3\theta\eta_{0i}(v_{ri} + v_{0i})}{\alpha_i\left[1 - e^{-\theta\left(K - \frac{T_{0i}}{h_{0i} \cdot B}\right)}\right]} - k_{rg} \cdot (1 + K_{rs}) \cdot Ra_{ir0} \cdot e^{-B_L \cdot L_i}$$

in the formula, $k_{rg}$ represents the coefficient of the strength of entrainment of lubricant by the longitudinal surface roughness of the work roll and the strip steel, and is in the range of 0.09-0.15, and $K_{rs}$ represents the impression rate, that is, the ratio of transferring the surface roughness of the working roll to the strip; and

S9.3, calculating an emulsion flow rate comprehensive optimization objective function $$\begin{cases} F(X) = \frac{\lambda}{n}\sum_{i=1}^{n}\sqrt{(\xi_i - \xi_{0i})^2} + (1-\lambda)\max|\xi_i - \xi_{0i}| \\ \xi_i^- < \xi_i < \xi_i^+ \end{cases}$$

in the formula, $X=\{w_i\}$ is the optimization variable and $\lambda$ is the distribution coefficient.

In the present application, as long as the next step is not conditional on the result of the previous step, it is not necessary to follow the steps, unless the next step depends on the previous step.

(III) Beneficial Effects the technical solution of the invention is adopted, and the emulsion flow optimization method for suppressing vibration of the cold continuous rolling mill fully combines the device and process features of the cold continuous rolling mill, and aiming at the problems of vibration defects, starting from the comprehensive optimization setting for the emulsion flow rate of each rolling stand and changing the previous idea of constant emulsion flow control for each rolling stand of the cold continuous rolling mill, the method obtains the optimal set value of the emulsion flow rate for each rolling stand that aims to achieve vibration suppression by optimization; and the method greatly reduces the incidence of rolling mill vibration defects, improves production efficiency and product quality, brings greater economic benefits for enterprises, treats rolling mill vibration defects, and improves the surface quality and rolling process stability of a finished strip of a cold continuous rolling mill.

BRIEF DESCRIPTION OF THE DRAWINGS

In the present invention, the same reference numerals always represent the same features, wherein.

DETAILED DESCRIPTION

The technical solution of the present invention will be further described in combination with the drawings and the embodiments.

Rolling mill vibration defects are very easily caused between roll gaps of each rolling stand of a cold continuous rolling mill, whether in an over-lubrication state or in an under-lubrication state, and the setting of the emulsion flow rate directly affects the lubrication state between the roll gaps of each rolling stand. In order to realize the treatment of the rolling mill vibration defects, starting from the emulsion flow rate, this patent ensures that both the overall lubrication state of the cold continuous rolling mill and the lubrication state of individual rolling stands can be optimum through the comprehensive optimal distribution of the emulsion flow rate of the cold continuous rolling mill, so as to achieve the goal of treating the rolling mill vibration defects, improving the surface quality and rolling process stability of a finished strip of the cold continuous rolling mill.

Figure 1:
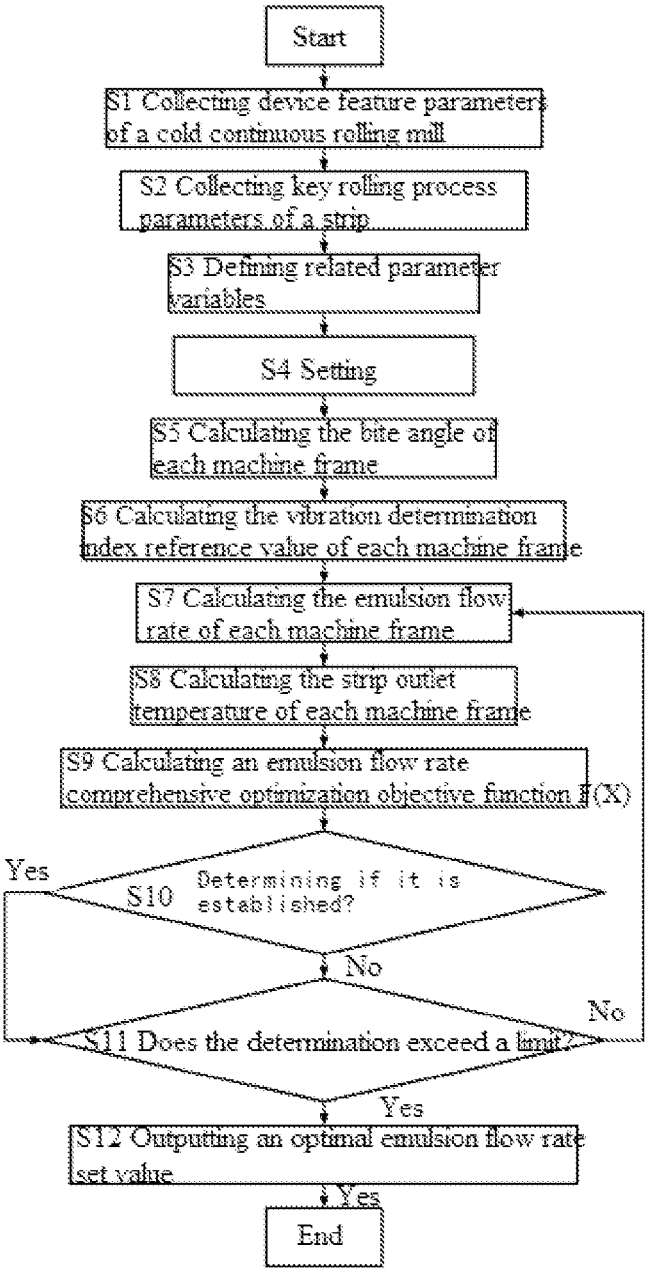
FIG. 1 is a flowchart of an emulsion flow optimization method of the present invention.

Referring to FIG. 1, an emulsion flow optimization method for suppressing vibration of a cold continuous rolling mill includes the following steps:

S1, collecting device feature parameters of the cold continuous rolling mill, wherein the device feature parameters include: the radius $R_i$ of a working roll of each rolling stand, the surface linear velocity $v_{ri}$ of a roll of each rolling stand, the original roughness $Ra_{ir0}$ of a working roll of each rolling stand, the roughness attenuation coefficient $B_L$ of a working roll, the distance l between rolling stands, and the rolling kilometer $L_i$ after roll change of a working roll of each rolling stand, wherein i is 1, 2, . . . , n, and represents for the ordinal number of rolling stands of the cold continuous rolling mill, and n is the total number of rolling stands;

S2, collecting key rolling process parameters of a strip, wherein the key rolling process parameters include: the inlet thickness $h_{0i}$ of each rolling stand, the outlet thickness $h_{1i}$ of each rolling stand, strip width B, the inlet speed $v_{0i}$ of each rolling stand, the outlet speed $v_{1i}$ of each rolling stand, the inlet temperature $T_1^r$, strip deformation resistance $K_i$ of each rolling stand, rolling pressure $P_i$ of each rolling stand, back tension $T_{0i}$ of each rolling stand, front tension $T_{1i}$ of each rolling stand, emulsion concentration influence coefficient $k_c$, pressure-viscosity coefficient θ of a lubricant, strip density ρ, specific heat capacity S of a strip, emulsion concentration C, emulsion temperature $T_c$ and thermal-work equivalent J;

S3, defining process parameters involved in the process of emulsion flow optimization, wherein the process parameters include that an over-lubrication film thickness critical value of each rolling stand is $\xi_i^+$ and the friction coefficient at this time is $u_i^+$, an under-lubrication film thickness critical value is $\xi_i^+$ and the friction coefficient at this time is $u_i^-$, the rolling reduction amount is $\Delta h_i = h_{0i} - h_{1i}$, the rolling reduction rate is $$\varepsilon_i = \frac{\Delta h_i}{h_{0i}},$$

the inlet temperature of each rolling stand is $T_i^r$, the distance l between the rolling stands is evenly divided into m sections, and the temperature in the sections is represented by $T_{i,j}$ (wherein, $1 \le j \le m$), and $T_i^r = T_{i-1,m}$, the over-lubrication judgment coefficient is $A^+$, and the under-lubrication judgment coefficient is $A^-$;

S4, setting the initial set value of an emulsion flow rate comprehensive optimization objective function of the cold continuous rolling mill that aims to achieve vibration suppression as $F_0 = 1.0 \times 10^{10}$;

the executing order of steps S1 to S4 is not limited, and in some cases, steps S1 to S4 can be performed simultaneously.

Figure 2:
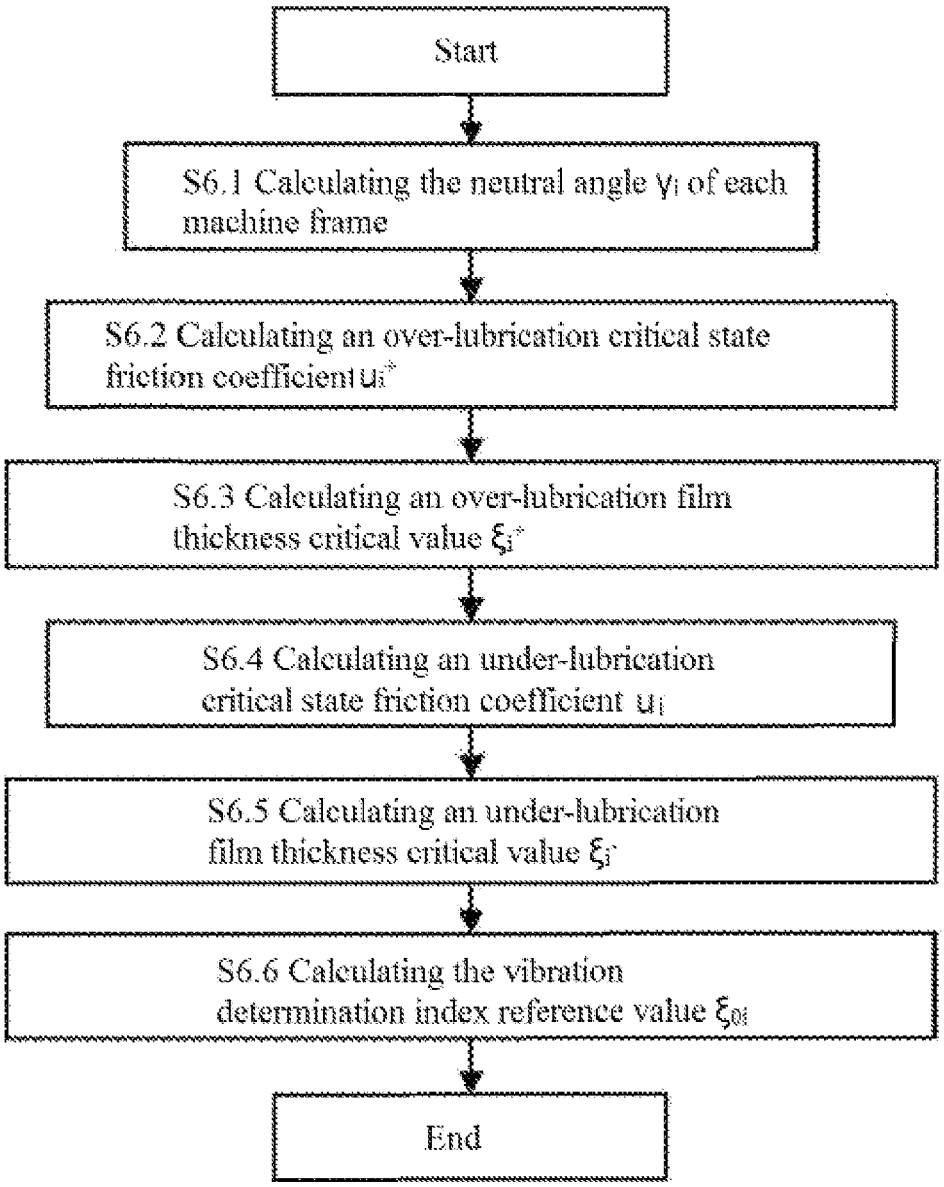
FIG. 2 is a flowchart of calculating the vibration determination index reference value.

S5, calculating the bite angle $\alpha_i$ of each rolling stand according to the rolling theory, wherein the calculation formula is as follows:

$$\alpha_i = \sqrt{\frac{\Delta h_i}{R_i'}}, R_i'$$

is the flattening radius of the working roll of the $i^{th}$ rolling stand, and is the calculation process value of rolling pressure;

S6, calculating the vibration determination index reference value $\xi_{0i}$ of each rolling stand, wherein the calculation flowchart is shown in FIG. 2;

S6.1, calculating the neutral angle $\gamma_i$ of each rolling stand:

$$\gamma_i = \frac{1}{2}\sqrt{\frac{\Delta h_i}{R_i'}}\left[1 + \frac{1}{2u_i}\left(\sqrt{\frac{\Delta h_i}{R_i'}} + \frac{T_{i0} - T_{i1}}{P_i}\right)\right];$$

S6.2, calculating to obtain $$u_i^+ = \frac{1}{2(2A^+ - 1)}\left(\sqrt{\frac{\Delta h_i}{R_i'}} + \frac{T_{i0} - T_{i1}}{P_i}\right)$$

from steps S5 and S6.1 assuming that when $$\frac{\gamma_i}{\alpha_i} = A^+,$$

the roll gap is just in an over-lubrication state;

S6.3, calculating an over-lubrication film thickness critical value $\xi_i^+$ of each rolling stand according to the relationship formula between the friction coefficient and the oil film thickness, namely $u_i = a_i + b_i \cdot e^{B_i \cdot \xi_i}$ (in the formula, $a_i$ is the liquid friction influence coefficient, $b_i$ is the dry friction influence coefficient, and $B_i$ is the friction coefficient attenuation index), wherein $$\xi_i^+ = \frac{1}{B_i}\ln\frac{u_i^+ - a_i}{b_i};$$

S6.4, calculating to obtain $$u_i^- = \frac{1}{2(2A^- - 1)}\left(\sqrt{\frac{\Delta h_i}{R_i'}} + \frac{T_{i0} - T_{i1}}{P_i}\right)$$

from steps S5 and S6.1 assuming that when $$\frac{\gamma_i}{\alpha_i} = A^-,$$

the roll gap is just in an under-lubrication state;

S6.5, calculating an under-lubrication film thickness critical value $\xi_i^-$ of each rolling stand according to the relationship formula between the friction coefficient and the oil film thickness, namely $u_i = a_i + b_i \cdot e^{B_i \cdot \xi_i}$, wherein $$\xi_i^- = \frac{1}{B_i}\ln\frac{u_i^- - a_i}{b_i};$$

and

S6.6, calculating the vibration determination index reference value $\xi_{0i}$ of each rolling stand, wherein $$\xi_{0i} = \frac{\xi_i^+ + \xi_i^-}{2};$$

Figure 3:
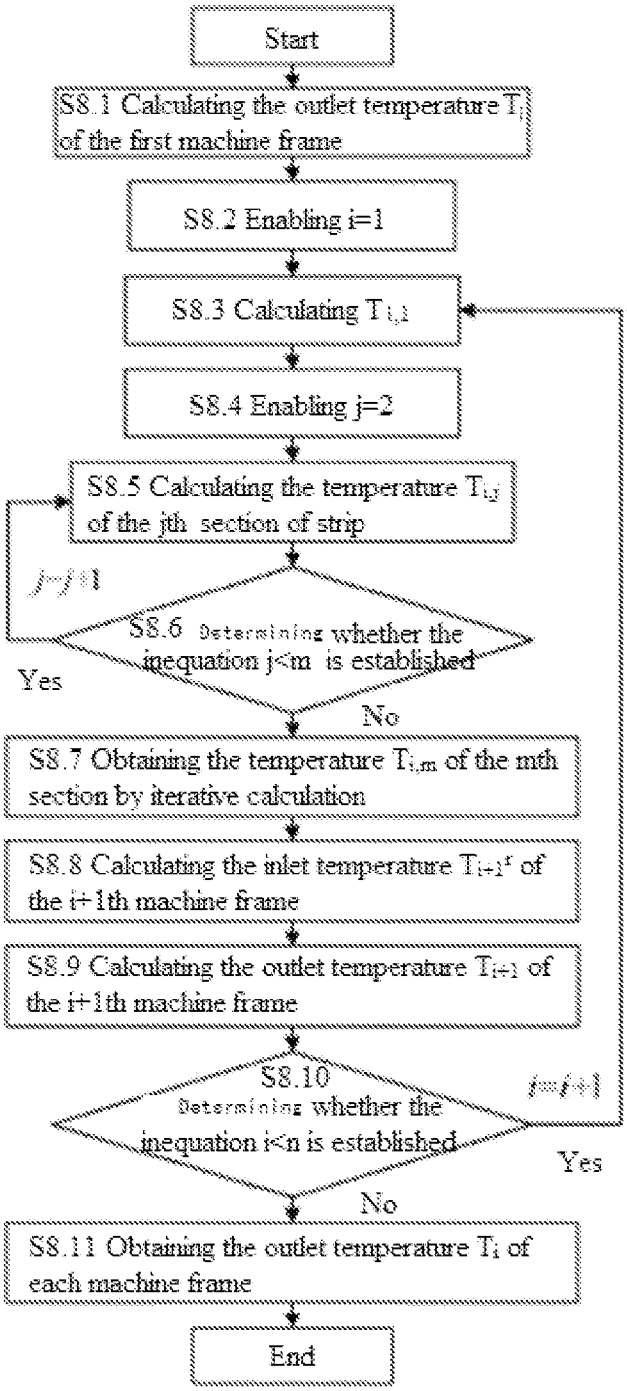
FIG. 3 is a flowchart of calculating the strip outlet temperature of each rolling stand.

S7, setting the emulsion flow rate $w_i$ of each rolling stand;

S8, calculating the strip outlet temperature $T_i$ of each rolling stand, wherein the calculation flowchart is shown in FIG. 3, S8.1, calculating the outlet temperature $T_1$ of the first rolling stand, wherein $$T_1 = T_1^r + \frac{1-(\varepsilon_1/4)}{1-(\varepsilon_1/2)}\cdot\frac{K_1\ln\left(\frac{1}{1-\varepsilon_1}\right)}{\rho SJ};$$

S8.2, enabling i=1;

S8.3, calculating the temperature $T_{i,1}$ of the first section of strip behind the outlet of the $i^{th}$ rolling stand, i.e. $T_{i,1}=T_i$;

S8.4, enabling j=2;

S8.5, showing the relationship between the temperature of the $j^{th}$ section and the temperature of the $j-1^{th}$ section by the following equation:

$$\tau_{i,j} = -\frac{2k_0 w_i^{0.264}\exp(9.45-0.1918C)\times 1.163l}{v_{1i}h_{1i}\rho Sm}T_{i,j-1}^{-0.213}(T_{i,j-1}-T_c)+T_{i,j-1},$$

wherein $k_0$ is the influence coefficient of the nozzle shape and spraying angle, and $0.80<k_0<1.2$;

S8.6, determining whether the in-equation j<m is established, if yes, enabling j=j+1, and then turning to step S8.5; otherwise, turning to step S8.7;

S8.7, obtaining the temperature $T_{i,m}$ of the $m^{th}$ section by iterative calculation;

S8.8, calculating the inlet temperature $T_{i+1}^r$ of the $i+1^{th}$ rolling stand: $T_{1+1}^r=T_{i,m}$;

S8.9, calculating the outlet temperature $T_{i+1}$ of the $i+1^{th}$ rolling stand, wherein $$T_{i+1} = T_{i+1}^r + \frac{1-(\varepsilon_{i+1}/4)}{1-(\varepsilon_{i+1}/2)}\cdot\frac{K_{i+1}\ln\left(\frac{1}{1-\varepsilon_{i+1}}\right)}{\rho SJ};$$

Figure 4:
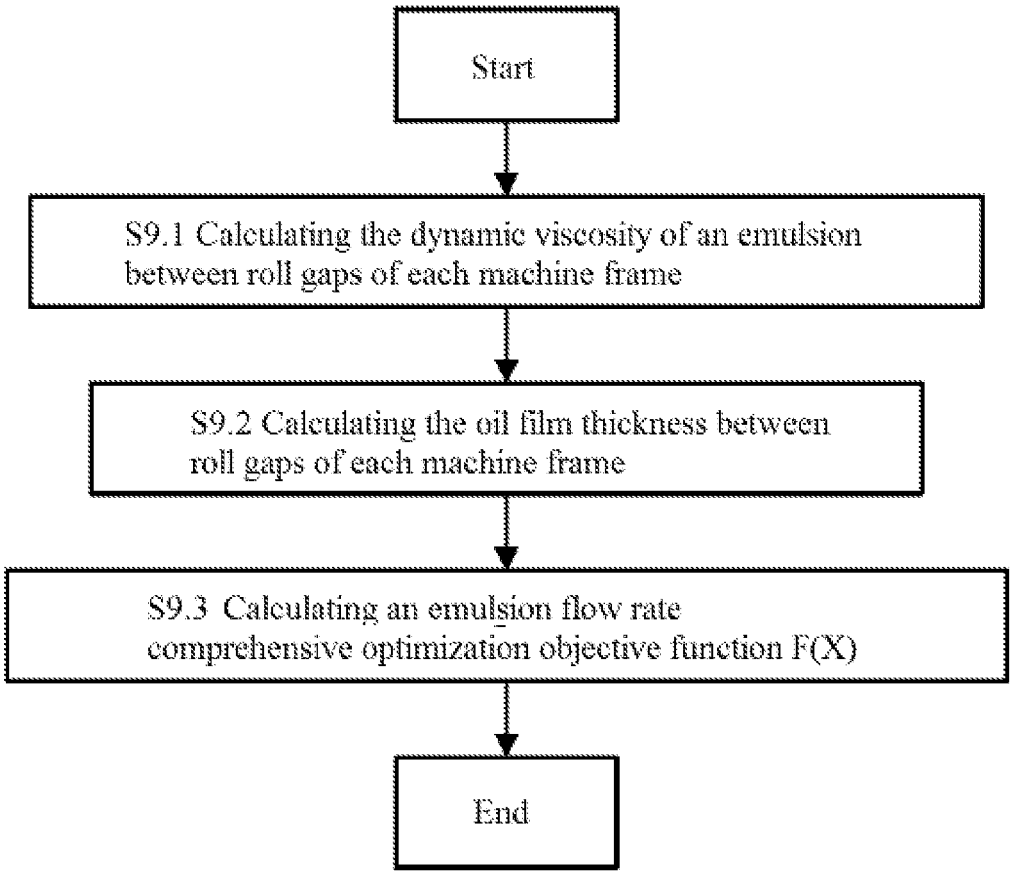
FIG. 4 is a flowchart of calculating an emulsion flow comprehensive optimization objective function.

S8.10, determining whether the in-equation i<n is established, if yes, enabling i=i+1, and then turning to step S8.3; otherwise, turning to step S8.11; and S8.11, obtaining the outlet temperature $T_i$ of each rolling stand;

S9, calculating an emulsion flow rate comprehensive optimization objective function F(X), wherein the calculation flowchart is shown in FIG. 4, S9.1, calculating the dynamic viscosity $\eta_{0i}$ of an emulsion between roll gaps of each rolling stand, wherein $\eta_{0i}=b\cdot\exp(-a\cdot T_i)$, in the formula, a,b are the dynamic viscosity parameters of lubricating oil under atmospheric pressure;

S9.2, calculating the oil film thickness $\xi_i$ between the roll gaps of each rolling stand, wherein the calculation formula is as follows:

$$\xi_i = \frac{h_{0i}+h_{1i}}{2h_{0i}}\cdot k_c\cdot\frac{3\theta\eta_{0i}(v_{ri}+v_{0i})}{\alpha_i\left[1-e^{-\theta\left(K-\frac{T_{0i}}{h_{0i}\cdot B}\right)}\right]} - k_{rg}\cdot(1+K_{rs})\cdot Ra_{ir0}\cdot e^{-B_L\cdot L_i}$$

in the formula, $k_{rg}$ represents the coefficient of the strength of entrainment of lubricant by the longitudinal surface roughness of the work roll and the strip steel, and is in the range of 0.09-0.15, and $K_{rs}$ represents the impression rate, that is, the ratio of transferring the surface roughness of the working roll to the strip; and S9.3, calculating an emulsion flow rate comprehensive optimization objective function:

$$\begin{cases} F(X) = \frac{\lambda}{n}\sum_{i=1}^{n}\sqrt{(\xi_i-\xi_{0i})^2} + (1-\lambda)\max|\xi_i-\xi_{0i}| \\ \xi_i^- < \xi_i < \xi_i^+ \end{cases}$$

in the formula, $X=\{w_i\}$ is the optimization variable and $\lambda$ is the distribution coefficient;

S10, determining whether the in-equation $F(X)<F_0$ is established, if yes, enabling $w_i^y=w_i$, $F_0=F(X)$, and then turning to step S11; otherwise, turning directly to step S11;

S11, determining whether the emulsion flow rate $w_i$ exceeds the a feasible region range, if yes, turning to step S12; otherwise, turning to step S7, wherein the feasible region of $w_i$ ranges from 0 to the maximum emulsion flow rate value allowed by the rolling mill.

S12, outputting an optimal emulsion flow rate set value $w_i^y$, wherein $w_i^y$ is the value of $w_i$ when the calculated value of F(X) in the feasible region is minimum.

Embodiment 1

In order to further explain the application process of the related technology of the present application, the application process of an emulsion flow optimization method for a cold continuous rolling mill that aims to achieve vibration suppression is described by taking a 1730 cold continuous rolling mill in a cold rolling plant as an example.

An emulsion flow optimization method for suppressing vibration of a cold continuous rolling mill includes the following steps:

S1, collecting device feature parameters of the cold continuous rolling mill, wherein the 1730 cold continuous rolling mill in a cold rolling plant has 5 rolling stands in total, and the device feature parameters mainly include: the radius $R_i$={210,212,230,230,228} mm of a working roll of each rolling stand, the surface linear velocity $v_{ri}$={180,320,500,800,1150} m/min of a roll of each rolling stand, the original roughness $Ra_{ir0}$={1.0,1.0,0.8,0.8,1.0} um of a working roll of each rolling stand, the roughness attenuation coefficient $B_L$=0.01 of a working roll, the distance l=2700 mm between rolling stands, and the rolling kilometer $L_i$={100,110,230,180,90} km after roll change of a working roll of each rolling stand, wherein i is 1, 2, . . . , n, and represents the ordinal number of rolling stands of the cold continuous rolling mill, and n=5 is the total number of rolling stands, the same below;

S2, collecting key rolling process parameters of a strip, wherein the key rolling process parameters mainly include: the inlet thickness $h_{0i}$={2.0,1.14,0.63,0.43, 0.28} mm of each rolling stand, the outlet thickness $h_{1i}$={1.14,0.63,0.43,0.28,0.18} mm of each rolling stand, strip width B=966 mm, the inlet speed $v_{0i}$={110, 190,342,552,848} m/min of each rolling stand, the outlet speed $v_{1i}$={190,342,552,848,1214} m/min of each rolling stand, the inlet temperature $T_1^r$=110° C., strip deformation resistance $K_i$={360,400,480,590, 650} MPa of each rolling stand, rolling pressure $P_i$={12800,11300,10500,9600,8800} kN of each rolling stand, back tension $T_{0i}$={70,145,208,202,229} MPa of each rolling stand, front tension $T_{1i}$={145,208, 202,229,56} MPa of each rolling stand, emulsion concentration influence coefficient $k_c$=0.9, pressure-viscosity coefficient θ=0.034 of a lubricant, strip density ρ=7800 kg/m$^3$, specific heat capacity S=0.47 kJ/(kg·° C.) of a strip, emulsion concentration C=4.2%, emulsion temperature $T_c$=58° C. and thermal-work equivalent J=1;

S3, defining process parameters involved in the process of emulsion flow optimization, wherein the process parameters mainly include that an over-lubrication film thickness critical value of each rolling stand is $\xi_i^+$ and the friction coefficient at this time is $u_i^+$, an under-lubrication film thickness critical value is $\xi_i^-$ and the friction coefficient at this time is $u_i^-$, the rolling reduction amount is $\Delta h_i=h_{0i}-h_{1i}$, the rolling reduction rate is $$\varepsilon_i = \frac{\Delta h_i}{h_{0i}},$$

the inlet temperature of each rolling stand is $T_i^r$, and the distance l=2700 mm between the rolling stands is evenly divided into m=30 sections, and the temperature in the sections is represented by $T_{i,j}$ (wherein, $1 \le j \le m$), and $T_i^r = T_{i-1,m}$, the over-lubrication judgment coefficient is $A^+$, and the under-lubrication judgment coefficient is $A^-$;

S4, setting the initial set value of an emulsion flow rate comprehensive optimization objective function of the cold continuous rolling mill that aims to achieve vibration suppression as $F_0=1.0\times10^{10}$;

S5, calculating the bite angle $\alpha_i$ of each rolling stand according to the rolling theory, wherein the calculation formula is $$\alpha_i = \sqrt{\frac{\Delta h_i}{R_i'}},$$

from which it can be obtained that $\alpha_i$={0.0556,0.0427, 0.0258,0.0223,0.0184};

S6, calculating the vibration determination index reference value $\xi_{0i}$ of each rolling stand;

S6.1, calculating the neutral angle $\gamma_i$ of each rolling stand, wherein the calculation formula is $$\gamma_i = \frac{1}{2}\sqrt{\frac{\Delta h_i}{R_i'}}\left[1 + \frac{1}{2u_i}\left(\sqrt{\frac{\Delta h_i}{R_i'}} + \frac{T_{i0} - T_{i1}}{P_i}\right)\right];$$

S6.2, calculating to obtain $u_i^+$={0.0248,0.0186,0.0132, 0.0136,0.0191} according to the formula $$u_i^+ = \frac{1}{2(A^+ - 1)}\left(\sqrt{\frac{\Delta h_i}{R_i'}} + \frac{T_{i0} - T_{i1}}{P_i}\right)$$

from steps S5 and S6.1 assuming that when $$\frac{\gamma_i}{\alpha_i} = A^+ = 1,$$

the roll gap is just in an over-lubrication state;

S6.3, calculating an over-lubrication film thickness critical value $\xi_i^+$ each rolling stand according to the relationship formula between the friction coefficient and the oil film thickness, i.e. $u_i=a_i+b_i\cdot e^{B_i\cdot\xi^*_{is\ i}}$ (in the formula, $a_i$ is the liquid friction influence coefficient, $a_i$=0.0126, $b_i$ is the dry friction influence coefficient, $b_i$=0.1416, and $B_i$ is the friction coefficient attenuation index, $B_i$=−2.4297), wherein the calculation formula is $$\xi_i^+ = \frac{1}{B_i}\ln\frac{u_i^+ - a_i}{b_i},$$

from which it can be obtained that: $\xi_i^+$={1.009,1.301,2.249, 2.039,1.268} um;

S6.4, calculating to obtain $u_i^-$={0.1240,0.0930,0.0660, 0.0680,0.0955} according to the formula $$u_i^- = \frac{1}{2(A^- - 1)}\left(\sqrt{\frac{\Delta h_i}{R_i'}} + \frac{T_{i0} - T_{i1}}{P_i}\right)$$

from steps S5 and S6.1 assuming that when $$\frac{\gamma_i}{\alpha_i} = A^- = 0.6,$$

the roll gap is just in an under-lubrication state;

S6.5, calculating an under-lubrication film thickness critical value $\xi_i^-$ of each rolling stand according to the relationship formula between the friction coefficient and the oil film thickness, i.e. $u_i=a_i+b_i\cdot e^{B_i\cdot\xi^*_{is\ i}}$, wherein the calculation formula is $$\xi_i^- = \frac{1}{B_i}\ln\frac{u_i^- - a_i}{b_i},$$

from which it can be obtained that: $\xi_i^-$={0.098,0.233,0.401, 0.386,0.220} um;

S6.6, calculating the vibration determination index reference value $\xi_{0i}$, wherein $$\xi_{0i} = \frac{\xi_i^+ + \xi_i^-}{2},$$

from which it can be obtained that: $\xi_{0i}$={0.554,0.767,1.325, 1.213,0.744};

S7. Setting the emulsion flow rate of each rolling stand to be $w_i$={900,900,900,900,900} L/min;

S8, calculating the strip outlet temperature $T_i$ of each rolling stand,

S8.1, calculating the outlet temperature $T_1$ of the first rolling stand, $$T_1 = T_1^r + \frac{1-(\varepsilon_1/4)}{1-(\varepsilon_1/2)} \cdot \frac{K_1 \ln\left(\frac{1}{1-\varepsilon_1}\right)}{\rho S J} = 110 + \frac{1-(0.43/4)}{1-(0.43/2)} \cdot \frac{360\ln\left(\frac{1}{1-0.43}\right)}{7.8 \cdot 0.47 \cdot 1} = 172.76^\circ \text{ C.}$$

S8.2, enabling i=1;

S8.3, calculating the temperature $T_{1,1}$ of the first section of strip behind the outlet of the first rolling stand, i.e. $T_{i,1}=T_i=172.76^\circ$ C.;

S8.4, enabling j=2;

S8.5, showing the relationship formula between the temperature of the $j^{th}$ section and the temperature of the $j-1^{th}$ section by the following equation:

$$T_{i,j} = -\frac{2k_0 w^{0.264} \exp(9.45 - 0.1918C) \times 1.163l}{v_{1i},\, h_{1i}\rho S m} T_{i,j-1}^{-0.213}(T_{i,j-1} - T_c) + T_{i,j-1},$$

wherein $k_0$=1.0;

S8.6, determining whether the in-equation j<m is established: if yes, enabling j=j+1. and then turning to step S8.5; otherwise, turning to step S8.7;

S8.7, obtaining the temperature $T_{1,30}=103.32^\circ$ C. of the $m=30^{th}$ section by iterative calculation finally;

S8.8, calculating the inlet temperature $T_2^r$ of the second rolling stand: $T_2^r=T_{1,m}=103.32^\circ$ C.;

S8.9, calculating the outlet temperature $T_2$ of the second rolling stand:

$$T_2 = T_2^r + \frac{1-(\varepsilon_2/4)}{1-(\varepsilon_2/2)} \cdot \frac{K_2 \ln\left(\frac{1}{1-\varepsilon_2}\right)}{\rho S J} = 103.32 + \frac{1-(0.45/4)}{1-(0.45/2)} \cdot \frac{400\ln\left(\frac{1}{1-0.45}\right)}{7800 \cdot 0.47 \cdot 1} = 178.02^\circ \text{ C.;}$$

S8.10, determining whether the in-equation i<n is established: if yes, enabling i=i+1, and then turning to step S8.3; otherwise, turning to step S8.11;

S8.11, obtaining the outlet temperature $T_i$={172.76, 178.02,186.59,194.35,206.33}° C. of each rolling stand;

S9, calculating an emulsion flow rate comprehensive optimization objective function F(X);

S9.1, calculating the dynamic viscosity $\eta_{0i}$ of an emulsion between roll gaps of each rolling stand, wherein $\eta_{0i}=b\cdot\exp(-a\cdot T_i)$, in the formula, a,b are the dynamic viscosity parameters of lubricating oil under atmospheric pressure, and it can be obtained from a=0.05, b=2.5 that $\eta_{0i}$={5.39,5.46,5.59,5.69,5.84};

S9.2, calculating the oil film thickness $\xi_i$ between the roll gaps of each rolling stand according to the following formula:

$$\xi_i = \frac{h_{0i} + h_{1i}}{2h_{0i}} \cdot k_c \cdot \frac{3\theta\eta_{0i}(v_{ri} + v_{0i})}{\alpha_i\left[1 - e^{-\theta\left(K - \frac{T_{0i}}{h_{0i} \cdot B}\right)}\right]} - k_{rg} \cdot (1 + K_{rs}) \cdot Ra_{ir0} \cdot e^{-B_{Li} \cdot L_i}$$

wherein in the formula, $k_{rg}$ represents the coefficient of the strength of entrainment of lubricant by the longitudinal surface roughness of the work roll and the strip steel, $k_{rg}$=1.183, and $K_{rs}$ represents the impression rate, that is, the ratio of transferring the surface roughness of the working roll to the strip, $K_{rs}$=0.576, from which it can be obtained that: $\xi_i$={0.784,0.963,2.101,2.043,1.326} um;

S9.3, calculating an emulsion flow rate comprehensive optimization objective function:

$$\begin{cases} F(X) = \frac{\lambda}{n}\sum_{i=1}^{n}\sqrt{(\xi - \xi_{0i})^2} + (1-\lambda)\max|\xi_i - \xi_{0i}| \\ \xi_i^- < \xi_i < \xi_i^+ \end{cases}$$

in the formula, X={$w_i$} is the optimization variable, λ=0.5 is the distribution coefficient, and thus F(X)=0.94;

S10, enabling $w_i^y=w_i$={900,900,900,900,900} L/min if $F(X)=0.94<F_0=1\times10^{10}$ is established, $F_0$=F(X)=0.94, turning to step S11, wherein in the subsequent x calculation processes, the corresponding F(X) is obtained with the change of $w_i$, and the $x^{th}$ $F_0$ is the $x-1^{th}$ F(X). If the $x^{th}$ F(X) is smaller than the $x-1^{th}$ F(X), it is judged that $F(X)<F_0$ is established and turn to step S11;

S11, determining whether the emulsion flow rate $w_i$ exceeds the feasible region range. If yes, turning to step S12; otherwise, turning to step S7; and

S12, outputting an optimal emulsion flow rate set value $w_i^y$={1022,1050,1255,1698,1102} L/min.

Embodiment 2

In order to further explain the application process of the related technology of the present application, the application process of an emulsion flow optimization method for a cold continuous rolling mill that aims to achieve vibration suppression is described by taking a 1420 cold continuous rolling mill in a cold rolling plant as an example.

An emulsion flow optimization method for suppressing vibration of a cold continuous rolling mill includes the following steps:

S1, collecting device feature parameters of the cold continuous rolling mill, wherein the 1420 cold continuous rolling mill in a cold rolling plant has 5 rolling stands in total, and the device feature parameters mainly include: the radius $R_i$={211,213,233,233,229} mm of a working roll of each rolling stand, the surface linear velocity $v_{ri}$={182,322,504,805,1153} m/min of a roll of each rolling stand, the original roughness $Ra_{ir0}$={1.0,1.0,0.9,0.9,1.0} um of a working roll of each rolling stand, the roughness attenuation coefficient $B_L$=0.015 of a working roll, the distance l=2750 mm between rolling stands, and the rolling kilometer $L_i$={120,130,230,190,200} km after roll change of a working roll of each rolling stand, wherein i is 1, 2, . . . , n, and represents the ordinal number of rolling stands of the cold continuous rolling mill, and n=5 is the total number of rolling stands, the same below;

S2, collecting key rolling process parameters of a strip, wherein the key rolling process parameters mainly include: the inlet thickness $h_{0i}$={2.1,1.15,0.65,0.45,0.3} mm of each rolling stand, the outlet thickness $h_{1i}$={1.15,0.65,0.45,0.3,0.15} mm of each rolling stand, strip width B=955 mm, the inlet speed $v_{0i}$={115,193,346,555,852} m/min of each rolling stand, the outlet speed $v_{1i}$={191,344,556,849,1217} m/min of each rolling stand, the inlet temperature $T_1^r$=115° C. strip deformation resistance $K_i$={370,410,490,590,660} MPa of each rolling stand, rolling pressure $P_i$={12820,11330,10510,9630,8820} kN of each rolling stand, back tension $T_{0i}$={73,148,210,205,232}MPa of each rolling stand, front tension $T_{1i}$={147,212,206,231,60} MPa of each rolling stand, emulsion concentration influence coefficient $k_c$=0.9, pressure-viscosity coefficient θ=0.036 of a lubricant, strip density ρ=7800 kg/m$^3$, specific heat capacity S=0.49 kJ/(kg·° C.) of a strip, emulsion concentration C=4.5%, emulsion temperature $T_c$=59° C. and thermal-work equivalent J=1;

S3, defining process parameters involved in the process of emulsion flow optimization, wherein the process parameters mainly include that an over-lubrication film thickness critical value of each rolling stand is $\xi_i^+$ and the friction coefficient at this time is $u_i^+$, an under-lubrication film thickness critical value is $\xi_i^-$ and the friction coefficient at this time is $u_i^-$, the rolling reduction amount is $\Delta h_i=h_{0i}-h_{1i}$, the rolling reduction rate is $$\varepsilon_i = \frac{\Delta h_i}{h_{0i}},$$

the inlet temperature of each rolling stand is $T_i^r$, the distance l=2750 mm between the rolling stands is evenly divided into m=30 sections, and the temperature in the sections is represented by $T_{i,j}$ (wherein, 1≤j≤m), and $T_i^r=T_{i-1,m}$, the over-lubrication judgment coefficient is $A^+$, and the under-lubrication judgment coefficient is $A^-$;

S4, setting the initial set value of an emulsion flow rate comprehensive optimization objective function of a cold continuous rolling mill that aims to achieve vibration suppression as $F_0=1.0\times10^{10}$;

S5, calculating the bite angle $\alpha_i$ of each rolling stand according to the rolling theory, wherein the calculation formula is $$\alpha_i = \sqrt{\frac{\Delta h_i}{R_i'}},$$

from which it can be obtained that $\alpha_i$={0.0566,0.0431,0.0261,0.0227,0.0188};

S6, calculating the vibration determination index reference value $\xi_{0i}$ of each rolling stand;

S6.1, calculating the neutral angle $\gamma_i$ of each rolling stand, wherein the calculation formula is $$\gamma_i = \frac{1}{2}\sqrt{\frac{\Delta h_i}{R_i'}}\left[1+\frac{1}{2u_i}\left(\sqrt{\frac{\Delta h_i}{R_i'}}+\frac{T_{i0}-T_{i1}}{P_i}\right)\right];$$

S6.2, calculating to obtain $u_i^+$={0.0251,0.0187,0.0135,0.0138,0.0193} according to the formula $$u_i^+ = \frac{1}{2(A^+-1)}\left(\sqrt{\frac{\Delta h_i}{R_i'}}+\frac{T_{i0}-T_{i1}}{P_i}\right)$$

from steps S5 and S6.1 assuming that when $$\frac{\gamma_i}{\alpha_i} = A^+ = 1,$$

the roll gap is just in an over-lubrication state;

S6.3, calculating an over-lubrication film thickness critical value $\xi_i^+$ of each rolling stand according to the relationship formula between the friction coefficient and the oil film thickness, i.e. $u_i=a_i+b_i\cdot e^{B_i\cdot\xi^*is\ i}$ (in the formula, $a_i$ is the liquid friction influence coefficient, $a_i$=0.0128, $b_i$ is the dry friction influence coefficient, $b_i$=0.1426, and $B_i$ is the friction coefficient attenuation index, $B_i$—2.4307), wherein the calculation formula is $$\xi_i^+ = \frac{1}{B_i}\ln\frac{u_i^+-a_i}{b_i},$$

from which it can be obtained that: $\xi_i^+$={1.011,1.321,2.253,2.041,1.272} um;

S6.4, calculating to obtain $u_i^-$={0.1243,0.0936,0.0664,0.0685,0.0955} according to the formula $$u_i^- = \frac{1}{2(A^--1)}\left(\sqrt{\frac{\Delta h_i}{R_i'}}+\frac{T_{i0}-T_{i1}}{P_i}\right)$$

from steps S5 and S6.1 assuming that when $$\frac{\gamma_i}{\alpha_i} = A^- = 0.6,$$

the roll gap is just in an under-lubrication state;

S6.5, calculating an under-lubrication film thickness critical value $\xi_i^-$ of each rolling stand according to the relationship formula between the friction coefficient and the oil film thickness, i.e. $u_i=a_i+b_i\cdot e^{B_i\cdot\xi^*is\ i}$, wherein the calculation formula is $$\xi_i^- = \frac{1}{B_i}\ln\frac{u_i^--a_i}{b_i},$$

from which it can be obtained that: $\xi_i^-$={0.101,0.236,0.411,0.389,0.223} um;

S6.6, calculating the vibration determination index reference value $\xi_{0i}$, wherein $$\xi_{0i} = \frac{\xi_i^+ + \xi_i^-}{2},$$

from which it can be obtained that: $\xi_{0i}$={0.557,0.769,1.327,1.215,0.746};

S7, setting the emulsion flow rate of each rolling stand to be $w_i$={900,900,900,900,900} L/min;

S8, calculating the strip outlet temperature $T_i$ of each rolling stand,

S8.1, calculating the outlet temperature $T_1$ of the first rolling stand, $$T_1 = T_1^r + \frac{1-(\varepsilon_1/4)}{1-(\varepsilon_1/2)} \cdot \frac{K_1 \ln\left(\frac{1}{1-\varepsilon_1}\right)}{\rho S J} = 110 + \frac{1-(0.43/4)}{1-(0.43/2)} \cdot \frac{360 \ln\left(\frac{1}{1-0.43}\right)}{7.8 \cdot 0.47 \cdot 1} = 175.81^\circ \text{ C.}$$

S8.2, enabling i=1;

S8.3, calculating the temperature $T_{1,1}$ of the first section of strip behind the outlet of the first rolling stand, i.e. $T_{i,1}=T_i=175.81^\circ$ C.;

S8.4, enabling j=2;

S8.5, showing the relationship between the temperature of the $j^{th}$ section and the temperature of the $j-1^{th}$ section by the following equation:

$$T_{i,j} = -\frac{2k_0 w_i^{0.264} \exp(9.45 - 0.1918C) \times 1.163l}{v_{1i} h_{1i} \rho S m} T_{i,j-1}^{-0.213}(T_{i,j-1} - T_c) + T_{i,j-1}, \quad \text{wherein } k_0 = 1.0;$$

S8.6, determining whether the in-equation j<m is established: if yes, enabling j=j+1. and then turning to step S8.5; otherwise, turning to step S8.7;

S8.7, obtaining the temperature $T_{1,30}=105.41^\circ$ C. of the $m=30^{th}$ section by iterative calculation finally;

S8.8, calculating the inlet temperature $T_2^r$ of the second rolling stand: $T_2^r=T_{1,m}=105.41^\circ$ C.;

S8.9, calculating the outlet temperature $T_2$ of the second rolling stand $$T_2 = T_2^r + \frac{1-(\varepsilon_2/4)}{1-(\varepsilon_2/2)} \cdot \frac{K_2 \ln\left(\frac{1}{1-\varepsilon_2}\right)}{\rho S J} = 103.32 + \frac{1-(0.45/4)}{1-(0.45/2)} \cdot \frac{400 \ln\left(\frac{1}{1-0.45}\right)}{7800 \cdot 0.47 \cdot 1} = 182.52^\circ \text{ C.}$$

S8.10, determining whether the in-equation i<n is established: if yes, enabling i=i+1, and then turning to step S8.3; otherwise, turning to step S8.11;

S8.11, obtaining the outlet temperature $T_i$={175.86, 179.36,189.77,196.65,207.54}° C. of each rolling stand;

S9, calculating an emulsion flow rate comprehensive optimization objective function F(X);

S9.1, calculating the dynamic viscosity $\eta_{0i}$ of an emulsion between roll gaps of each rolling stand, wherein $\eta_{0i}=b\cdot\exp(-a\cdot T_i)$, in the formula, a,b are the dynamic viscosity parameters of lubricating oil under atmospheric pressure, and it can be obtained from a=0.15, b=3.0 that $\eta_{0i}$={5.45,5.78,5.65,5.75,5.89};

S9.2, calculating the oil film thickness $\xi_i$ between the roll gaps of each rolling stand according to the following formula:

$$\xi_i = \frac{h_{0i} + h_{1i}}{2h_{0i}} \cdot k_c \cdot \frac{3\theta\eta_{0i}(v_{ri} + v_{0i})}{\alpha_i\left[1 - e^{-\theta\left(K - \frac{T_{0i}}{h_{0i} \cdot B}\right)}\right]} - k_{rg} \cdot (1 + K_{rs}) \cdot Ra_{ir0} \cdot e^{-B_{Li} \cdot L_i}$$

wherein in the formula, $k_{rg}$ represents the coefficient of the strength of entrainment of lubricant by the longitudinal surface roughness of the work roll and the strip steel, $k_{rg}$=1.196, and $K_{rs}$ represents the impression rate, that is, the ratio of transferring the surface roughness of the working roll to the strip, $K_{rs}$=0.584, from which it can be obtained that: $\xi_i$={0.795,0.967,2.132,2.056,1.337} um;

S9.3, calculating an emulsion flow rate comprehensive optimization objective function:

$$\begin{cases} F(X) = \frac{\lambda}{n}\sum_{i=1}^{n}\sqrt{(\xi_i - \xi_{0i})^2} + (1-\lambda)\max|\xi_i - \xi_{0i}| \\ \xi_i^- < \xi_i < \xi_i^+ \end{cases}$$

in the formula, X={$w_i$} is the optimization variable, λ=0.5 is the distribution coefficient, and thus F(X)=0.98;

S10, enabling $w_i^y=w_i$={900,900,900,900,900} L/min if $F(X)=0.98<F_0=1\times10^{10}$ is established, $F_0=F(X)=0.98$, turning to step S11, wherein in the subsequent x calculation processes, the corresponding F(X) is obtained with the change of $w_i$, and the $x^{th}$ $F_0$ is the $x-1^{th}$ F(X). If the $x^{th}$ F(X) is smaller than the $x-1^{th}$ F(X), it is judged that $F(X)<F_0$ is established and turn to step S11;

S11, determining whether the emulsion flow rate $w_i$ exceeds the feasible region range. If yes, turning to step S12; otherwise, turning to step S7; and

S12, outputting an optimal emulsion flow rate set value $w_i^y$={1029,1055,1261,1703,1109} L/min.

Embodiment 3

In order to further explain the application process of the related technology of the present application, the application process of an emulsion flow optimization method for a cold continuous rolling mill that aims to achieve vibration suppression is described by taking a 1220 cold continuous rolling mill in a cold rolling plant as an example.

An emulsion flow optimization method for suppressing vibration of a cold continuous rolling mill includes the following steps:

S1, collecting device feature parameters of the cold continuous rolling mill, wherein the 1220 cold continuous rolling mill in a cold rolling plant has 5 rolling stands in total, and the device feature parameters mainly include: the radius $R_i$={208,210,227,226,225} mm of a working roll of each rolling stand, the surface linear velocity $v_{ri}$={176,317,495,789,1146} m/min of a roll of each rolling stand, the original roughness $Ra_{ir0}$={0.9,0.9,0.7,0.7,0.8} um of a working roll of each rolling stand, the roughness attenuation coefficient $B_L$=0.01 of a working roll, the distance l=2700 mm between rolling stands, and the rolling kilometer $L_i$={152,102,215,165,70} km after roll change of a working roll of each rolling stand, wherein i is 1, 2, . . . , n, and represents the ordinal number of rolling stands of the cold continuous rolling mill, and n=5 is the total number of rolling stands, the same below;

S2, collecting key rolling process parameters of a strip, wherein the key rolling process parameters mainly include: the inlet thickness $h_{0i}$={1.8,1.05,0.57,0.39, 0.25} mm of each rolling stand, the outlet thickness $h_{1i}$={1.05,0.57,0.36,0.22,0.13} mm of each rolling stand, strip width B=876 mm, the inlet speed $v_{0i}$={104, 185,337,546,844} m/min of each rolling stand, the outlet speed $v_{1i}$={188,337,548,845,1201}m/min of each rolling stand, the inlet temperature $T_1^r$=110° C. strip deformation resistance $K_i$={355,395,476,580, 640} MPa of each rolling stand, rolling pressure $P_i$={12900,11200,10400,9600,8900} kN of each rolling stand, back tension $T_{0i}$={74,141,203,201,219} MPa of each rolling stand, front tension $T_{1i}$={140,203, 199,224,50} MPa of each rolling stand, emulsion concentration influence coefficient $k_c$=0.8, pressure-viscosity coefficient θ=0.035 of a lubricant, strip density ρ=7800 kg/m$^3$, specific heat capacity S=0.45 kJ/(kg·° C.) of a strip, emulsion concentration C=3.7%, emulsion temperature $T_c$=55° C. and thermal-work equivalent J=1;

S3, defining process parameters involved in the process of emulsion flow optimization, wherein the process parameters mainly include that an over-lubrication film thickness critical value of each rolling stand is $\xi_i^+$ and the friction coefficient at this time is $u_i^+$, an under-lubrication film thickness critical value is $\xi_i^-$ and the friction coefficient at this time is $u_i^-$, the rolling reduction amount is $\Delta h_i=h_{0i}-h_{1i}$, the rolling reduction rate is $$\varepsilon_i = \frac{\Delta h_i}{h_{0i}},$$

the inlet temperature of each rolling stand is $T_i^r$, the distance l=2700 mm between the rolling stands is evenly divided into m=30 sections, and the temperature in the sections is represented by $T_{i,j}$ (wherein, 1≤j≤m), and $T_i^r=T_{i+1,m}$, the over-lubrication judgment coefficient is $A^+$, and the under-lubrication judgment coefficient is $A^-$;

S4, setting the initial set value of an emulsion flow rate comprehensive optimization objective function of a cold continuous rolling mill that aims to achieve vibration suppression as $F_0=1.0\times10^{10}$;

S5, calculating the bite angle $\alpha_i$ of each rolling stand according to the rolling theory, wherein the calculation formula is $$\alpha_i = \sqrt{\frac{\Delta h_i}{R_i'}},$$

from which it can be obtained that $\alpha_i$={0.0546,0.0406, 0.0247,0.0220,0.0179};

S6, calculating the vibration determination index reference value $\xi_{0i}$ of each rolling stand;

S6.1, calculating the neutral angle $\gamma_i$ of each rolling stand, wherein the calculation formula is $$\gamma_i = \frac{1}{2}\sqrt{\frac{\Delta h_i}{R_i'}}\left[1+\frac{1}{2u_i}\left(\sqrt{\frac{\Delta h_i}{R_i'}}+\frac{T_{i0}-T_{i1}}{P_i}\right)\right];$$

S6.2, calculating to obtain $u_i^+$={0.0242,0.0179,0.0127, 0.0130,0.0185} according to the formula $$u_i^+ = \frac{1}{2(A^+-1)}\left(\sqrt{\frac{\Delta h_i}{R_i'}}+\frac{T_{i0}-T_{i1}}{P_i}\right)$$

from steps S5 and S6.1 assuming that when $$\frac{\gamma_i}{\alpha_i} = A^+ = 1,$$

the roll gap is just in an over-lubrication state;

S6.3, calculating an over-lubrication film thickness critical value $\xi_i^+$ of each rolling stand according to the relationship formula between the friction coefficient and the oil film thickness, i.e. $u_i=a_i=b_i\cdot e^{B_i\cdot\xi_i}$ (in the formula, $a_i$ is the liquid friction influence coefficient, $a_i$=0.0125, $b_i$ is the dry friction influence coefficient, $b_i$=0.1414, and $B_i$ is the friction coefficient attenuation index, $B_i$=−2.4280), wherein the calculation formula is $$\xi_i^+ = \frac{1}{B_i}\ln\frac{u_i^+-a_i}{b_i},$$

from which it can be obtained that: $\xi_i^+$={1.001,1.289,2.232, 2.037,1.268} um;

S6.4, calculating to obtain $u_i^-$={0.1241,0.0922,0.0610, 0.0630,0.0935} according to the formula $$u_i^- = \frac{1}{2(A^--1)}\left(\sqrt{\frac{\Delta h_i}{R_i'}}+\frac{T_{i0}-T_{i1}}{P_i}\right)$$

from steps S5 and S6.1 assuming that when $$\frac{\gamma_i}{\alpha_i} = A^- = 0.6,$$

the roll gap is just in an under-lubrication state;

S6.5, calculating an under-lubrication film thickness critical value $\xi_i^-$ of each rolling stand according to the relationship between the friction coefficient and the oil film thickness, i.e. $u_i=a_i=b_i\cdot e^{B_i\cdot\xi_i}$, wherein the calculation formula is $$\xi_i^- = \frac{1}{B_i}\ln\frac{u_i^--a_i}{b_i},$$

from which it can be obtained that: $\xi_i^-$={0.097,0.223,0.398, 0.385,0.210} um;

S6.6, calculating the vibration determination index reference value $\xi_{0i}$, wherein $$\xi_{0i} = \frac{\xi_i^+ + \xi_i^-}{2},$$

from which it can be obtained that: $\xi_{0i}$={0.548,0.762,1.321, 1.207,0.736};

S7, setting the emulsion flow rate of each rolling stand to be $w_i$={900,900,900,900,900} L/min;

S8, calculating the strip outlet temperature $T_i$ of each rolling stand,

S8.1, calculating the outlet temperature $T_1$ of the first rolling stand, $$T_1 = T_1^r + \frac{1-(\varepsilon_1/4)}{1-(\varepsilon_1/2)} \cdot \frac{K_1 \ln\left(\frac{1}{1-\varepsilon_1}\right)}{\rho S J} = 110 + \frac{1-(0.43/4)}{1-(0.43/2)} \cdot \frac{360 \ln\left(\frac{1}{1-0.43}\right)}{7.8 \cdot 0.47 \cdot 1} = 169.96^\circ \text{ C.}$$

S8.2, enabling i=1;

S8.3, calculating the temperature $T_{1,1}$ of the first section of strip behind the outlet of the first rolling stand, i.e. $T_{i,1}=T_i=169.96^\circ$ C.;

S8.4, enabling j=2;

S8.5, showing the relationship between the temperature of the $j^{th}$ section and the temperature of the $j-1^{th}$ section by the following equation:

$$T_{i,j} = -\frac{2k_0 w_i^{0.264} \exp(9.45 - 0.1918C) \times 1.163l}{v_{1i} h_{1i} \rho S m} T_{i,j-1}^{-0.213} (T_{i,j-1} - T_c) + T_{i,j-1},$$

wherein $k_0$=1.0;

S8.6, determining whether the in-equation j<m is established: if yes, enabling j=j+1. and then turning to step S8.5; otherwise, turning to step S8.7;

S8.7, obtaining the temperature $T_{1,30}$=101.25° C. of the m=$30^{th}$ section by iterative calculation finally;

S8.8, calculating the inlet temperature $T_2^r$ of the second rolling stand: $T_2^r=T_{1,m}$=101.25° C.;

S8.9, calculating the outlet temperature $T_2$ of the second rolling stand:

$$T_2 = T_2^r + \frac{1-(\varepsilon_2/4)}{1-(\varepsilon_2/2)} \cdot \frac{K_2 \ln\left(\frac{1}{1-\varepsilon_2}\right)}{\rho S J} = 103.32 + \frac{1-(0.45/4)}{1-(0.45/2)} \cdot \frac{400 \ln\left(\frac{1}{1-0.45}\right)}{7800 \cdot 0.47 \cdot 1} = 175.86^\circ \text{ C.}$$

S8.10, determining whether the in-equation i<n is established: if yes, enabling i=i+1, and then turning to step S8.3; otherwise, turning to step S8.11;

S8.11, obtaining the outlet temperature $T_i$={177.96, 172.78,184.59,191.77,203.33}° C. of each rolling stand;

S9, calculating an emulsion flow rate comprehensive optimization objective function F(X);

S9.1, calculating the dynamic viscosity $\eta_{0i}$ of an emulsion between roll gaps of each rolling stand, wherein $\eta_{0i}=b\cdot\exp(-a\cdot T_i)$, in the formula, a,b are the dynamic viscosity parameter of lubricating oil under atmospheric pressure, and it can be obtained from a=0.15, b=2.0 that $\eta_{0i}$={5.45,5.02,5.98,5.45,5.76};

S9.2, calculating the oil film thickness $\xi_i$ between the roll gaps of each rolling stand according to the following formula:

$$\xi_i = \frac{h_{0i} + h_{1i}}{2h_{0i}} \cdot k_c \cdot \frac{3\theta\eta_{0i}(v_{ri} + v_{0i})}{\alpha_i\left[1 - e^{-\theta\left(K - \frac{T_{0i}}{h_{0i} \cdot B}\right)}\right]} - k_{rg} \cdot (1 + K_{rs}) \cdot Ra_{ir0} \cdot e^{-B_{Li} \cdot L_i}$$

wherein in the formula, $k_{rg}$ represents the coefficient of the strength of entrainment of lubricant by the longitudinal surface roughness of the work roll and the strip steel, $k_{rg}$=1.165, and $K_{rs}$ represents the impression rate, that is, the ratio of transferring the surface roughness of the working roll to the strip, $K_{rs}$=0.566, from which it can be obtained that: $\xi_i$={0.774,0.926,2.088,2.032,1.318} um ;

S9.3, calculating an emulsion flow rate comprehensive optimization objective function:

$$\begin{cases} F(X) = \frac{\lambda}{n} \sum_{i=1}^{n} \sqrt{(\xi_i - \xi_{0i})^2} + (1-\lambda)\max|\xi_i - \xi_{0i}| \\ \xi_i^- < \xi_i < \xi_i^+ \end{cases}$$

In the formula, X={$w_i$} is the optimization variable, λ=0.5 is the distribution coefficient, and thus F(X)=0.91;

S10, enabling $w_i^y=w_i$={900,900,900,900,900} L/min if F(X)=0.91<$F_0=1\times10^{10}$ is established, $F_0$=F(X)=0.91, turning to step S11, wherein in the subsequent x calculation processes, the corresponding F(X) is obtained with the change of $w_i$, and the $x^{th}$ $F_0$ is the $x-1^{th}$ F(X). If the $x^{th}$ F(X) is smaller than the $x-1^{th}$ F(X), it is judged that F(X)<$F_0$ is established and turn to step S11;

S11, determining whether the emulsion flow rate $w_i$ exceeds the feasible region range. If yes, turning to step S12; otherwise, turning to step S7; and

S12, outputting an optimal emulsion flow rate set value $w_i^y$={1016,1040,1266,1681,1111}L /min .

The invention is applied to the five-machine-frame cold continuous rolling mills 1730, 1420 and 1220 in the cold rolling plant. According to the production experience of the cold rolling plant, the solution of the invention is feasible, and the effect is very obvious. The invention can be further applied to other cold continuous rolling mills, and the popularization prospect is relatively broad.

To sum up, the technical solution of the invention is adopted, and the emulsion flow optimization method for suppressing vibration of the cold continuous rolling mill fully combines the device and process features of the cold continuous rolling mill, and aiming at the vibration defect problem, starting from the comprehensive optimization setting of the emulsion flow rate of each rolling stand, the method changes the previous idea of constant emulsion flow control for each rolling stand of the cold continuous rolling mill, and obtains the optimal set value of the emulsion flow rate for each rolling stand that aims to achieve vibration suppression by optimization; and the method greatly reduces the incidence of rolling mill vibration defects, improves production efficiency and product quality, and brings greater economic benefits for enterprises; and achieves the treatment for rolling mill vibration defects, and improves the surface quality and rolling process stability of a finished strip of a cold continuous rolling mill.

The invention claimed is:

1. An emulsion flow optimization method for suppressing vibration of a cold continuous rolling mill, comprising the following steps:

(S1) collecting device feature parameters of the cold continuous rolling mill, wherein the device feature parameters comprise: a radius $R_i$ of a working roll of each of a plurality of rolling stands, a surface linear velocity $v_{ri}$ of a roll of each rolling stand, a original roughness $Ra_{ir0}$ of a working roll of each rolling stand, a roughness attenuation coefficient $B_L$ of a working roll, a distance l between rolling stands, and a rolling kilometer $L_i$ after roll change of a working roll of each rolling stand, wherein i is 1, 2, . . . , n, and represents an ordinal number of the rolling stands of the cold continuous rolling mill, and n is the total number of rolling stands;

(S2) collecting key rolling process parameters of a strip, wherein the key rolling process parameters comprise: an inlet thickness $h_{0i}$ of each rolling stand, an outlet thickness $h_{1i}$ of each rolling stand, a strip width B, an inlet speed $v_{0i}$ of each rolling stand, an outlet speed $v_{1i}$ of each rolling stand, an inlet temperature $T_1^r$, a strip deformation resistance $K_i$ of each rolling stand, a rolling pressure $P_i$ of each rolling stand, a back tension $T_{0i}$ of each rolling stand, a front tension $T_{1i}$ of each rolling stand, an emulsion concentration influence coefficient $k_c$, a pressure-viscosity coefficient θ of a lubricant, a strip density ρ, a specific heat capacity S of a strip, an emulsion concentration C, an emulsion temperature $T_c$ and a thermal-work equivalent J;

(S3) defining process parameters involved in an emulsion flow optimization process, wherein the process parameters comprise an over-lubrication film thickness critical value $\xi_i^+$ of each rolling stand, a first friction coefficient $u_i^+$ at this time, an under-lubrication film thickness critical value $\xi_i^-$ and a second friction coefficient $u_i^-$ at this time, a rolling reduction amount $\Delta h_i$ (wherein $\Delta h_i = h_{0i} - h_{1i}$), a rolling reduction rate $\varepsilon_i$ (wherein $$\varepsilon_i = \frac{\Delta h_i}{h_{0i}}$$

), an inlet temperature $T_i^r$ of each rolling stand, an over-lubrication judgment coefficient $A^+$, and an under-lubrication judgment coefficient $A^-$, and evenly dividing the distance l between the rolling stands into m sections, wherein a temperature in the sections is represented by $T_{i,j}$ (wherein $1 \le j \le m$, and $T_i^r = T_{i-1,m}$);

(S4) setting an initial set value of an emulsion flow rate comprehensive optimization objective function of the cold continuous rolling mill for achieving a vibration suppression as $F_0 = 1.0 \times 10^{10}$;

wherein an executing order of steps S1-S4 is not limited;

(S5) calculating a bite angle $\alpha_i$ of each rolling stand according to a rolling theory, wherein a calculation formula is as follows:

$$\alpha_i = \sqrt{\frac{\Delta h_i}{R_i'}}, R_i'$$

is a flattening radius of a working roll of an $i^{th}$ rolling stand, and is a calculation process value of rolling pressure;

(S6) calculating a vibration determination index reference value $\xi_{0i}$ of each rolling stand;

(S7) setting an emulsion flow rate $w_i$ of each rolling stand;

(S8) calculating a strip outlet temperature $T_i$ of each rolling stand;

(S9) calculating an emulsion flow rate comprehensive optimization objective function F(X);

$$\begin{cases} F(X) = \frac{\lambda}{n}\sum_{i=1}^{n}\sqrt{(\xi_i - \xi_{0i})^2} + (1-\lambda)\max|\xi_i - \xi_{0i}| \\ \xi_i^- < \xi_i < \xi_i^+ \end{cases};$$

(S10) determining whether an in-equation $F(X) < F_0$ is established, if yes, enabling $w_i^y = w_i$, $F_0 = F(X)$, and turning to step S11; otherwise, directly turning to step S11;

(S11) determining whether an emulsion flow rate $w_i$ exceeds a feasible region range, if yes, turning to step S12, otherwise, turning to step S7, wherein a feasible region of $w_i$ ranges from 0 to a maximum emulsion flow rate value allowed by the rolling mill; and (S12) outputting an optimum emulsion flow rate set value $w_i^y$, wherein $w_i^y$ is the value of $w_i$ when a calculated value of F(X) in the feasible region is minimum.

2. The emulsion flow optimization method for suppressing vibration of a cold continuous rolling mill according to claim 1, wherein the step S6 comprises the following steps:

(S6.1) calculating a neutral angle $\gamma_i$ of each rolling stand:

$$\gamma_i = \frac{1}{2}\sqrt{\frac{\Delta h_i}{R_i'}}\left[1 + \frac{1}{2u_i}\left(\sqrt{\frac{\Delta h_i}{R_i'}} + \frac{T_{i0} - T_{i1}}{P_i}\right)\right];$$

(S6.2) calculating to obtain $$u_i^+ = \frac{1}{2(2A^+ - 1)}\left(\sqrt{\frac{\Delta h_i}{R_i'}} + \frac{T_{i0} - T_{i1}}{P_i}\right)$$

from the step S5 and the step S6.1 assuming that when $$\frac{\gamma_i}{\alpha_i} = A^+,$$

a roll gap is just in an over-lubrication state;

(S6.3) calculating an over-lubrication film thickness critical value $\xi_i^+$ of each rolling stand according to a relation formula between the first friction coefficient $u_i^+$ and an oil film thickness wherein $u_i^+ = a_i + b_i \cdot e^{B_i \cdot \xi_i^+}$ in the formula, $a_i$ is a liquid friction influence coefficient, $b_i$ is a dry friction influence coefficient, and $B_i$ is a friction coefficient attenuation index, and wherein $$\xi_i^+ = \frac{1}{B_i}\ln\frac{u_i^+ - a_i}{b_i};$$

(S6.4) calculating to obtain $$u_i^- = \frac{1}{2(2A^- - 1)}\left(\sqrt{\frac{\Delta h_i}{R_i'}} + \frac{T_{i0} - T_{i1}}{P_i}\right)$$

from the step S5 and the step S6.1 assuming that when $$\frac{\gamma_i}{\alpha_i} = A^-,$$

a roll gap is just in an under-lubrication state;

(S6.5) calculating an under-lubrication film thickness critical value $\xi_i^-$ of each rolling stand according to a relation formula between the second friction coefficient $u_i^-$ and an oil film thickness wherein $u_i^- = a_i + b_i \cdot e^{B_i \cdot \xi_i^-}$, and wherein $$\xi_i^- = \frac{1}{B_i}\ln\frac{u_i^- - a_i}{b_i};$$

and (S6.6) calculating a vibration determination index reference value $\xi_{0i}$, wherein $$\xi_{0i} = \frac{\xi_i^+ + \xi_i^-}{2}.$$

3. The emulsion flow optimization method for suppressing vibration of a cold continuous rolling mill according to claim 2, wherein the step S8 comprises the following steps:

(S8.1) calculating an outlet temperature $T_1$ of a first rolling stand of the plurality of rolling stands, wherein $$T_1 = T_1^r + \frac{1 - (\varepsilon_1/4)}{1 - (\varepsilon_1/2)} \cdot \frac{K_1 \ln\left(\frac{1}{1 - \varepsilon_1}\right)}{\rho S J};$$

(S8.2) enabling i=1;

(S8.3) calculating a temperature $T_{i,1}$ of a first section of strip behind an outlet of the $i^{th}$ rolling stand, i.e. $T_{i,1} = T_i$;

(S8.4) enabling j=2;

(S8.5) calculating a temperature $T_{i,j}$ of a $j^{th}$ section of strip by a relationship between a temperature of the $j^{th}$ section and a temperature of a $j-1^{th}$ section shown by the following equation :

$$T_{i,j} = -\frac{2k_0 w_i^{0.264}\exp(9.45 - 0.1918C) \times 1.163l}{v_{1i} h_{1i} \rho S m} T_{i,j-1}^{0.213}(T_{i,j-1} - T_c) + T_{i,j-1},$$

wherein $k_0$ is an influence coefficient of nozzle shape and spraying angle;

(S8.6) determining whether an in-equation j<m is established, if yes, enabling j=j+1, and then turning to step S8.5; otherwise, turning to step S8.7;

(S8.7) obtaining a temperature $T_{i,m}$ of a $m^{th}$ section by iterative calculation;

(S8.8) calculating an inlet temperature $T_{i+1}^r$ of an $i+1^{th}$ rolling stand: $T_{i+1}^r = T_{i,m}$;

(58.9) calculating an outlet temperature $T_{i+1}$ of the $i+1^{th}$ rolling stand, wherein $$T_{i+1} = T_{i+1}^r + \frac{1 - (\varepsilon_{i+1}/4)}{1 - (\varepsilon_{i+1}/2)} \cdot \frac{K_{i+1}\ln\left(\frac{1}{1 - \varepsilon_{i+1}}\right)}{\rho S J};$$

(S8.10) determining whether the in-equation i<n is established, if yes, enabling i=i+1, and then turning to step S8.3; otherwise, turning to step S8.11; and (S8.11) obtaining an outlet temperature $T_i$ of each rolling stand.

4. The emulsion flow optimization method for suppressing vibration of a cold continuous rolling mill according to claim 3, wherein the step S9 comprises the following steps:

(S9.1) calculating a dynamic viscosity $\eta_{0i}$ of an emulsion between a roll gap of each of the plurality of rolling stands, wherein $\eta_{0i} = b \cdot \exp(-a \cdot T_i)$, and in the formula, a,b are dynamic viscosity parameters of lubricating oil under an atmospheric pressure;

(S9.2) calculating an oil film thickness $\xi_i$ between the roll gap of each of the plurality of rolling stands, wherein the calculation formula is as follows:

$$\xi_i = \frac{h_{0i} + h_{1i}}{2h_{0i}} \cdot k_c \cdot \frac{3\theta\eta_{0i}(v_{ri} + v_{0i})}{\alpha_i\left[1 - e^{-\theta\left(K\frac{T_{0i}}{h_{0i} \cdot B}\right)}\right]} - k_{rg} \cdot (1 + K_{rs}) \cdot Ra_{ir0} \cdot e^{-B_L \cdot L_i}$$

in the formula, $k_{rg}$ represents a coefficient of the strength of entrainment of lubricant by a longitudinal surface roughness of a work roll and a strip steel and is in a range of 0.09-0.15, $K_{rs}$ represents an impression rate, wherein a ratio of transferring a surface roughness of the working roll to the strip; and (S9.3) calculating an emulsion flow rate comprehensive optimization objective function, $$\begin{cases} F(X) = \frac{\lambda}{n}\sum_{i=1}^{n}\sqrt{(\xi_i - \xi_{0i})^2} + (1 - \lambda)\max|\xi_i - \xi_{0i}| \\ \xi_i^- < \xi_i < \xi_i^+ \end{cases}$$

in the formula, $X = \{w_i\}$ is an optimization variable, and $\lambda$ is a distribution coefficient.

5. The emulsion flow optimization method for suppressing vibration of a cold continuous rolling mill according to claim 3, wherein the influence coefficient of nozzle shape and spraying angle is equal to $0.8 < k_0 < 1.2$.

* * * * *